US008621917B2

(12) United States Patent
Fedewa

(10) Patent No.: US 8,621,917 B2
(45) Date of Patent: Jan. 7, 2014

(54) DIAGNOSTIC FOR TWO-MODE VARIABLE VALVE ACTIVATION DEVICE

(75) Inventor: Andrew M. Fedewa, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 228 days.

(21) Appl. No.: 13/315,566

(22) Filed: Dec. 9, 2011

(65) Prior Publication Data

US 2013/0145832 A1 Jun. 13, 2013

(51) Int. Cl.
*G01M 15/04* (2006.01)

(52) U.S. Cl.
USPC ..... 73/114.79

(58) Field of Classification Search
USPC ..... 73/114.77, 114.79
See application file for complete search history.

(56) References Cited

U.S. PATENT DOCUMENTS 6,668,779 B2 12/2003 Hendriksma et al.
7,047,924 B1 * 5/2006 Waters et al. ..... 123/90.16
7,063,057 B1 * 6/2006 Waters et al. ..... 123/90.16
7,761,217 B2 7/2010 Waters et al.
8,056,516 B2 * 11/2011 Cinpinski et al. ..... 123/90.15

FOREIGN PATENT DOCUMENTS

JP 2009-299503 12/2009

OTHER PUBLICATIONS

Pending U.S. Appl. No. 13/215,547, filed Aug. 23, 2011.

* cited by examiner

*Primary Examiner* — Eric S McCall
(74) *Attorney, Agent, or Firm* — Thomas N. Twomey

(57) ABSTRACT

A method is provided for diagnosing a multi-mode valve train device which selectively provides high lift and low lift to a combustion valve of an internal combustion engine having a camshaft phaser actuated by an electric motor. The method includes applying a variable electric current to the electric motor to achieve a desired camshaft phaser operational mode and commanding the multi-mode valve train device to a desired valve train device operational mode selected from a high lift mode and a low lift mode. The method also includes monitoring the variable electric current and calculating a first characteristic of the parameter. The method also includes comparing the calculated first characteristic against a predetermined value of the first characteristic measured when the multi-mode valve train device is known to be in the desired valve train device operational mode.

10 Claims, 8 Drawing Sheets

DIAGNOSTIC FOR TWO-MODE VARIABLE VALVE ACTIVATION DEVICE

GOVERNMENT-SPONSORED STATEMENT

This invention was made with the United States Government support under Contract DE-EE0003258 awarded by the U.S. Department of Energy. The Government has certain rights in this invention.

TECHNICAL FIELD OF INVENTION

The present invention relates to a multi-mode valve train device for selectively providing high lift and low lift to a combustion valve of an internal combustion engine; more particularly to a method for determining if the multi-mode valve train device has achieved the selected operational mode.

BACKGROUND OF INVENTION

Variable Valve Activation (VVA) mechanisms for internal combustion engines are well known. It is known to lower the lift, or even to provide no lift at all, of one or more valves of a multiple-cylinder engine, during periods of light engine load. Such deactivation or valve lift switching can substantially improve fuel efficiency.

Various approaches are known for changing the lift of valves in a running engine. One known approach is to provide an intermediate cam follower arrangement, which is rotatable about the engine camshaft and is capable of changing the valve lift and timing, the camshaft typically having both high-lift and low-lift lobes for each such valve.

For example, a Roller Finger Follower (RFF) typically acts between a rotating camshaft lobe and a pivot point such as a Hydraulic Lash Adjuster (HLA) to open and close an engine valve. By way of example, a switchable deactivation RFF includes an outer arm, also known as a body or low-lift follower, and an inner arm, also known as high-lift follower. The inner arm supports a roller carried by a shaft. Alternatively, the outer arm, rather than the inner arm, may support a pair of rollers carried by a shaft. Also alternatively, both the outer and inner arms may support rollers or both the outer an inner arms may not have rollers but rather incorporate sliding surfaces. The roller is engaged by a lobe of an engine camshaft that causes the outer arm to pivot about the HLA, thereby actuating an associated engine valve. The deactivation RFF is selectively switched between a coupled (high-lift) and decoupled (zero-lift) mode. In the coupled mode the inner arm is coupled to the outer arm by a movable latching mechanism and rotation of the lifting cam is transferred from the roller through the shaft to pivotal movement of the outer arm, which in turn, reciprocates the associated valve. In the decoupled mode, the inner arm is decoupled from the outer arm. Thus, the inner arm does not transfer rotation of the lifting cam lobe to pivotal movement of the outer arm, and the associated valve is not reciprocated. In this mode, the roller shaft is reciprocated within the outer arm.

A switchable, two-step RFF operates in a manner similar to the deactivation RFF, as described above. However, one particular difference between the operation of a deactivation RFF and a two-step RFF occurs in the decoupled mode of operation. When in the decoupled (zero-lift) mode, the outer arm of a deactivation RFF may be engaged by zero-lift cam lobes and remains in a static position allowing the associated valve to remain closed. On the other hand, when in decoupled (low-lift) mode, the outer arm of a two-step RFF is engaged by low-lift camshaft lobes to thereby reciprocate the associated engine valve according to the lift profile of the low-lift camshaft lobe.

A lost motion spring maintains contact between the roller and the lifting portion of the camshaft lobe when either type of RFF (i.e., deactivation or two-step) is in the decoupled (zero-lift or low-lift, respectively) mode and absorbs the reciprocal motion of the shaft and roller. The lost motion spring biases the inner arm away from the outer arm of the RFF. The expansion force of the lost motion spring acting on the inner arm must on the one hand be sufficient to maintain contact of the roller with the lifting portion of the cam lobe, while on the other hand must not cause the HLA, which supports the outer arm to be pumped down by the force of the lost motion spring.

Another known approach is to provide a deactivation mechanism in the Hydraulic Lash Adjuster (HLA) upon which a cam follower rocker arm pivots. Such arrangement is advantageous in that it can provide variable lift from a single cam lobe by making the HLA either competent or incompetent to transfer the motion of the cam eccentric to the valve stem. Yet another known approach is to provide a deactivation mechanism in the Hydraulic Valve Lifter (HVL).

During the operation of the above mentioned two-mode variable valve activation devices the two-mode variable valve actuation device may fail to achieve the selected mode of lift. U.S. Pat. No. 7,761,217 teaches a mechanism for detecting the lift mode by positioning a piezoelectric element relative to the lost motion spring such that the piezoelectric element acts a radio transmitter to transmit a radio signal when the piezoelectric element is subjected to a compressive load of the lost motion spring. In this way, a receiver can receive the radio signal and determine which lift mode the two-mode variable valve activation device is in and make a comparison against the selected lift mode. While this arrangement may be effective, cost and complexity is added to the system by the addition of the piezoelectric element and the receiver needed to receive the signal.

What is needed is a method for diagnosing or determining the lift mode of a two-mode variable valve actuation device.

SUMMARY OF THE INVENTION

Briefly described, a method is provided for diagnosing a multi-mode valve train device. The multi-mode valve train selectively provides high lift and low lift to a combustion valve of an internal combustion engine having a camshaft phaser actuated by an electric motor for varying the phase relationship between a camshaft and a crankshaft of the internal combustion engine. The method includes applying a variable electric current to the electric motor to achieve a desired camshaft phaser operational mode and commanding the multi-mode valve train device to a desired valve train device operational mode selected from a high lift mode for providing high lift to the combustion valve and a low lift mode for providing low lift to the combustion valve. The method also includes monitoring the variable electric current or a parameter of the camshaft phaser that is indicative of the variable electric current and calculating a first characteristic of the parameter. The method also includes determining a first actual valve train device operational mode of the multi-mode valve train device by comparing the calculated first characteristic against a predetermined value of the first characteristic measured when the multi-mode valve train device is known to be in the desired valve train device operational mode.

BRIEF DESCRIPTION OF DRAWINGS

This invention will be further described with reference to the accompanying drawings in which.

DETAILED DESCRIPTION OF INVENTION

Figure 1:
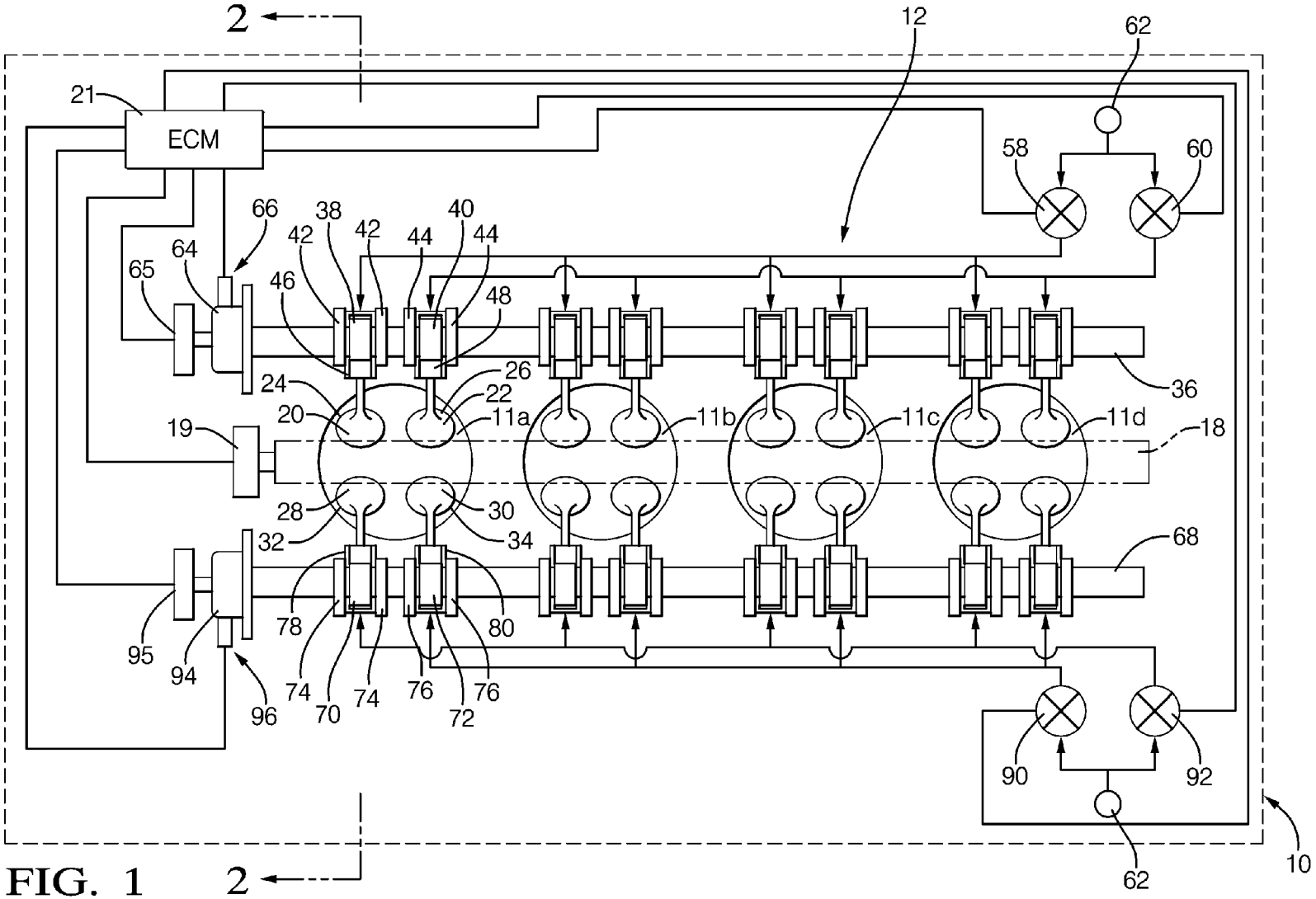
FIG. 1 is a schematic drawing of a four cylinder internal combustion engine in accordance with the invention.
Figure 2:
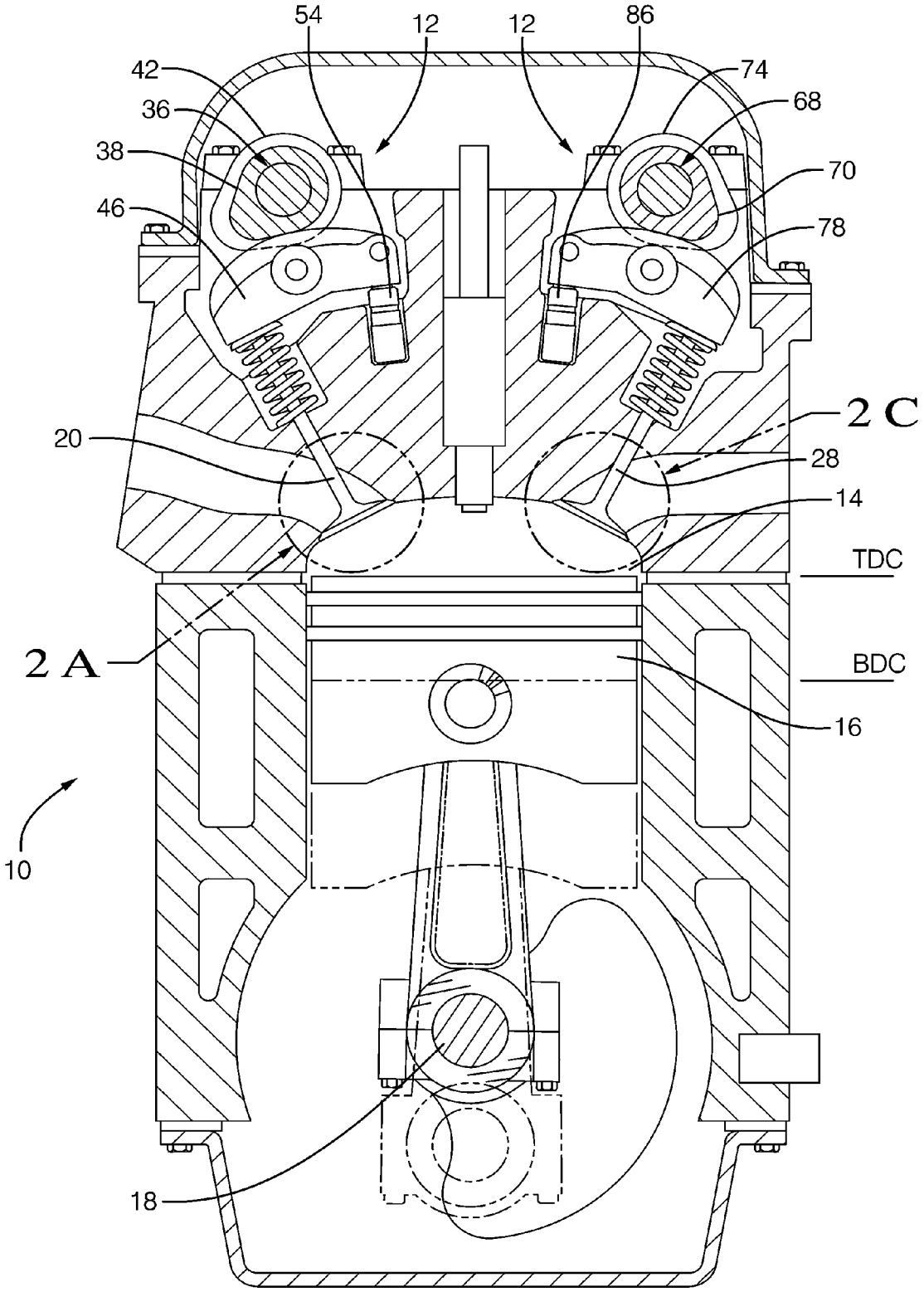
FIG. 2 is an elevation cross-sectional view of the internal combustion engine of FIG. 1 taken through section line 2-2.

In accordance with a preferred embodiment of this invention and referring to FIGS. 1 and 2, internal combustion engine 10 is shown which includes valve train system 12 for allowing at least a charge of air into combustion chamber 14 and for allowing exhaust constituents out of combustion chamber 14. For illustrative purposes only, internal combustion engine 10 is shown as a four cylinder, in-line engine with cylinders 11*a*, 11*b*, 11*c*, and 11*d*. Since cylinder 11*a* and its related components are substantially the same as cylinders 11*b*, 11*c*, and 11*d*, only cylinder 11*a* will be described with its related components. Piston 16 is disposed within combustion chamber 14 of cylinder 11*a* and is reciprocatable between a top-dead-center (TDC) position (shown as solid lines in FIG. 2) and a bottom dead center (BDC) position (shown as phantom lines in FIG. 2). A lower end of piston 16 is attached to crankshaft 18 which turns reciprocating motion of piston 16 into rotary motion. The rotational position of crankshaft 18 may be determined by crankshaft sensor 19 which provides crankshaft position information to engine control module (ECM) 21.

Figure 2A:
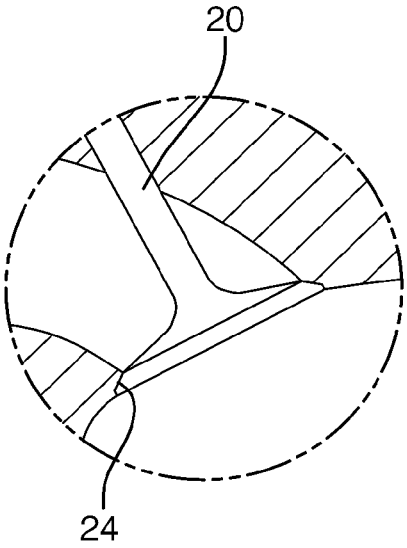
FIG. 2A is an enlarged view of the intake valve and intake valve seat of FIG. 2 shown in the intake closed position.
Figure 2B:
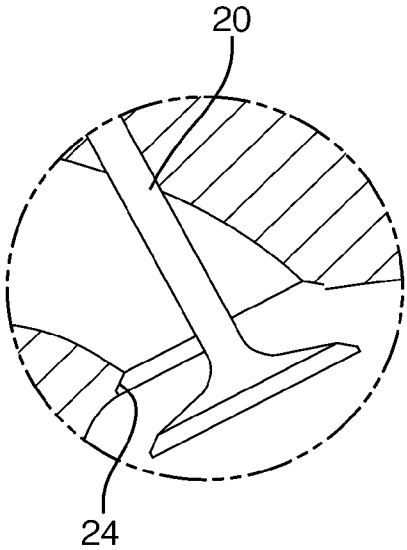
FIG. 2B is an enlarged view of the intake valve and intake valve seat of FIG. 2 shown in the intake open position.

Now referring to FIGS. 1, 2, 2A, 2B, and 3; valve train system 12 includes combustion valves shown as first and second intake valves 20, 22 which are moveable between an intake open position as shown in FIG. 2B for allowing the charge of at least air into combustion chamber 14 and an intake closed position as shown in FIGS. 2 and 2A for substantially preventing fluid communication into and out of combustion chamber 14 through first and second intake valves 20, 22. When first and second intake valves 20, 22 are in the intake closed position, first and second intake valves 20, 22 are seated against first and second intake valve seats 24, 26 respectively.

Figure 2C:
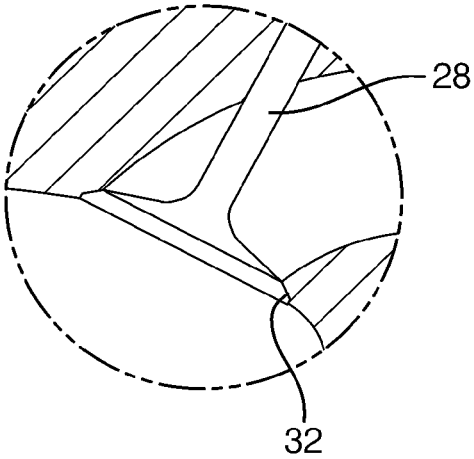
FIG. 2C is an enlarged view of the exhaust valve and exhaust valve seat of FIG. 2 shown in the exhaust closed position.
Figure 2D:
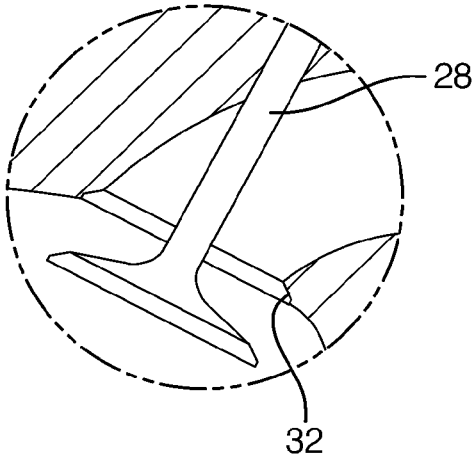
FIG. 2D is an enlarged view of the exhaust valve and exhaust valve seat of FIG. 2 shown in the exhaust open position.

Now referring to FIGS. 1, 2, 2C, 2D and 5; valve train system 12 also includes combustion valves shown as first and second exhaust valves 28, 30 which are moveable between an exhaust open position as shown in FIG. 2D and an exhaust closed position as shown in FIGS. 2 and 2C. The exhaust open position allows exhaust constituents to be expelled from combustion chamber 14 while the exhaust closed position substantially prevents fluid communication into and out of combustion chamber 14 through first and second exhaust valves 28, 30. When first and second exhaust valves 28, 30 are in the exhaust closed position, first and second exhaust valves 28, 30 are seated against first and second exhaust valve seats 32, 34 respectively.

Figure 3:
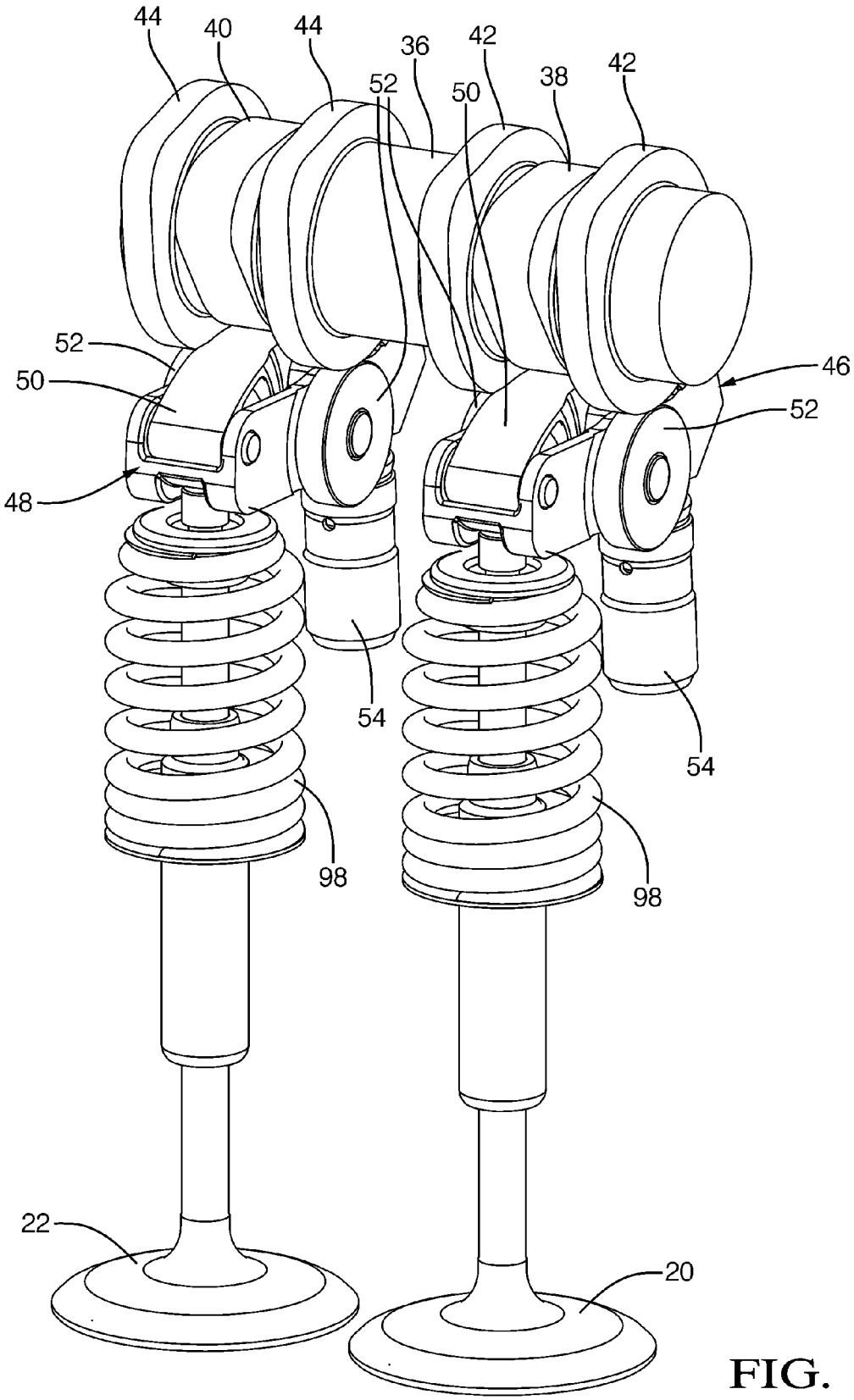
FIG. 3 is an isometric view of the intake valve train of the internal combustion engine of FIG. 1.

Now referring to FIGS. 1, 2, and 3; intake camshaft 36 is provided in valve train system 12 for moving first and second intake valves 20, 22 between the intake open and intake closed positions. Intake camshaft 36 may include first and second center high lift intake lobes 38, 40 such that first center high lift intake lobe 38 is associated with first intake valve 20 and second center high lift intake lobe 40 is associated with second intake valve 22. Intake camshaft 36 may also include first and second outer low lift intake lobe pairs 42, 44 such that first center high lift intake lobe 38 is disposed between first outer low lift intake lobe pair 42 and is associated with first intake valve 20 and second center high lift intake lobe 40 is disposed between second outer low lift intake lobe pair 44 and is associated with second intake valve 22.

First and second two-step intake devices 46, 48 may be provided to transmit motion from intake camshaft 36 to first and second intake valves 20, 22 respectively. An example of such first and second two-step intake devices are two-step roller finger followers as disclosed in U.S. Pat. No. 6,668,779 which is incorporated herein by reference in its entirety. First and second two-step intake devices 46, 48 are switchable between a locked and an unlocked position. In the locked position, center intake follower 50 is held at a fixed height with respect to outer intake followers 52 which are disposed on each side of center intake follower 50. In this way, first and second center high lift intake lobes 38, 40 act on their respective center intake follower 50. As intake camshaft 36 rotates, center intake follower 50 follows the profile of its respective center high lift intake lobe 38, 40. When center intake follower 50 follows the valve lifting portion of its center high lift intake lobe 38, 40, the two-step intake device pivots about intake lash adjuster 54, thereby lifting its respective intake valve 20, 22 from its respective intake valve seat 24, 26.

In the unlocked position, center intake follower 50 is not held at a fixed height with respect to outer intake followers 52. As center intake follower 50 follows the valve lifting portion of its center high lift intake lobe 38, 40, center intake follower 50 is allowed to compress which is known in the art as lost motion. In this way, center intake follower 50 does not cause first and second two-step intake devices 46, 48 to pivot about intake lash adjuster 54 and therefore does not impart motion on its respective intake valve 20, 22. Since center intake follower 50 is allowed to compress, outer intake followers 52 are permitted to follow the profiles of their respective outer low lift intake lobe pairs 42, 44. As intake camshaft 36 rotates, outer intake followers 52 follow the profile of their respective outer low lift intake lobe pairs 42, 44. In this way, first and second intake valves 20, 22, are moved between the intake open and intake closed positions by their respective outer low lift intake lobe pairs 42, 44 rather than by their respective center high lift intake lobe 38, 40.

Figure 4:
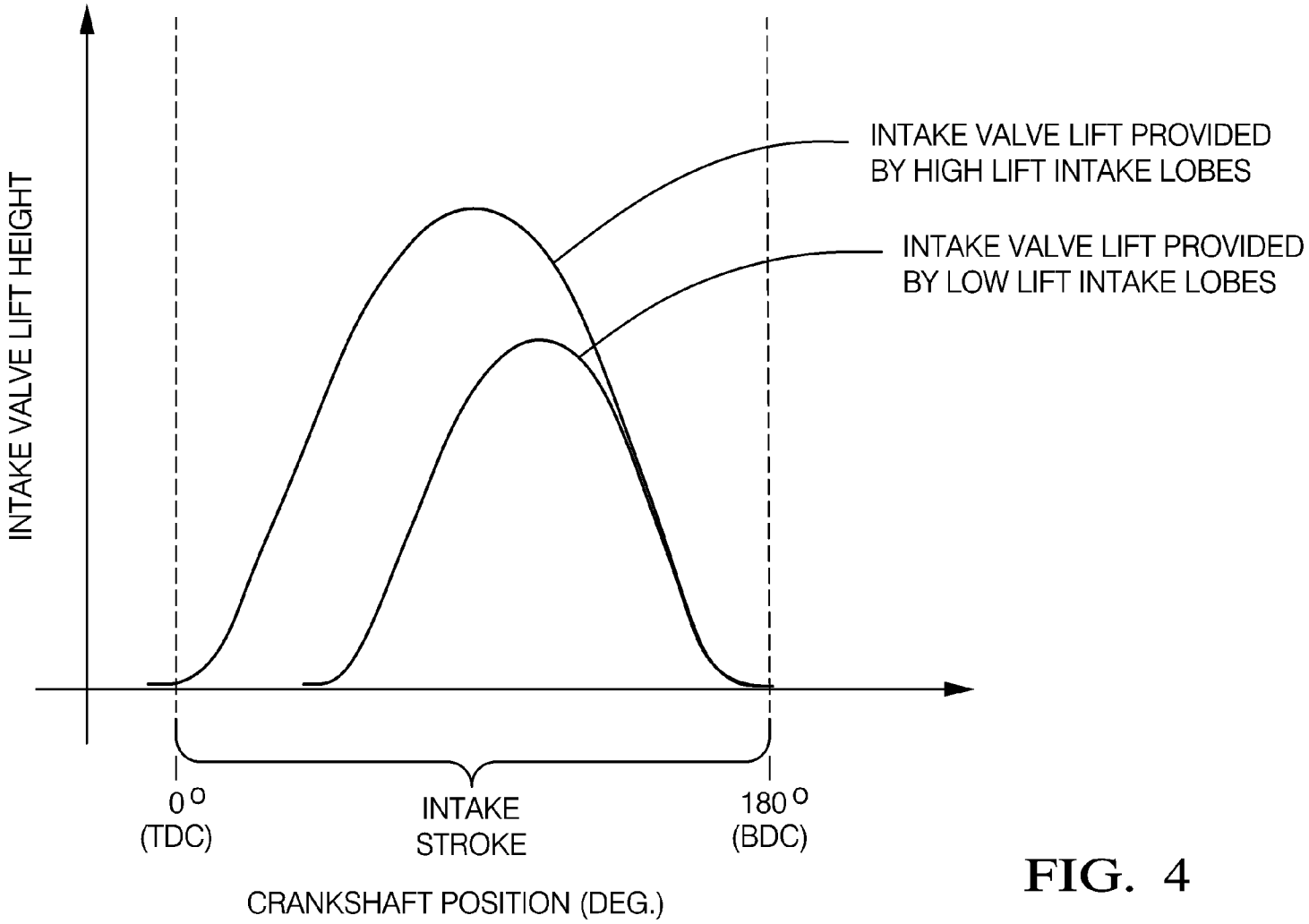
FIG. 4 is a graph showing the intake valve lift height provided by the high lift intake lobes and the low lift intake lobes.

It should be noted that in the locked position, first and second outer low lift intake lobe pairs 42, 44 do not affect the position of their respective intake valves 20, 22. This is because first and second center high lift intake lobes 38, 40 produce a larger valve lift than first and second outer low lift intake lobe pairs 42, 44 and also because the valve lifting portion of first and second center high lift intake lobes 38, 40 are larger than the lifting portion of first and second outer low lift intake lobe pairs 42, 44 at the same angular position on intake camshaft 36. FIG. 4 is a graph illustrating the height first and second intake valves 20, 22 are lifted from their respective intake valve seats 24, 26 in both the locked and unlocked positions during the intake stroke. As can be seen, in addition to a smaller magnitude of valve lift, first and second outer low lift intake lobe pairs 42, 44 also provide a shorter duration of lift (i.e. the lift occurs over a smaller portion of crankshaft rotation) and the peak lift is shifted to the right. Of course, numerous variations can be made to the valve lift characteristics and FIG. 4 is only provided as an example.

First and second two-step intake devices 46, 48 are each provided with an intake lock mechanism (not shown). First and second two-step devices 46, 48 are placed in the unlocked position when pressurized oil from internal combustion engine 10 is supplied to the intake lock mechanism. In this way, center intake follower 50 is not held at a fixed height with respect to outer intake followers 52. First and second two-step intake devices 46, 48 are placed in the locked position when the pressurized oil is drained from the intake lock mechanism. The supply of pressurized oil to the intake lock mechanism for each two-step intake device 46, 48 may be controlled by first and second intake oil control valves 58, 60 respectively which both receive pressurized oil from oil supply 62. First and second intake oil control valves 58, 60 may be controlled by input from engine control module 21. In this way, first and second two-step intake devices 46, 48 may both be simultaneously placed in the locked position or unlocked position or one of the first and second two-step intake devices 46, 48 may be placed in the locked position while the other of the first and second two-step intake devices 46, 48 is simultaneously placed in the unlocked position which may be useful, for example, for introducing swirl into combustion chamber 14 during the intake stroke of internal combustion engine 10.

Intake camshaft 36 may be provided with intake camshaft phaser 64 for varying the phase relationship between intake camshaft 36 and crankshaft 18. Intake camshaft phaser 64 is actuated by electric motor 65. Intake camshaft phaser 64 may, for example, include a harmonic gear drive unit, as shown in U.S. patent application Ser. No. 13/215,547 filed on Aug. 23, 2001, which is incorporated herein by reference in its entirety, to vary the phase relationship between intake camshaft 36 and crankshaft 18 based on rotational input from electric motor 65. However, it should be understood that the harmonic gear drive unit may be substituted by any number of gear drive units or gear reduction units commonly known for transmitting torque from a driving member to a driven member.

Intake camshaft 36 may also include intake camshaft sensing means 66 for detecting the rotational position of intake camshaft 36. Intake camshaft sensing means 66 may be, for example, a conventional camshaft sensor as is well known in the art or Hall Effect sensors of electric motor 65 as taught in U.S. patent application Ser. No. 13/215,547. Intake camshaft sensing means 66 provides intake camshaft position information to engine control module 21. In this way, engine control module 21 can determine the phase relationship between crankshaft 18 and intake camshaft 36 from the crankshaft position information and intake camshaft position information supplied by crankshaft sensor 19 and intake camshaft sensing means 66 respectively.

Figure 5:
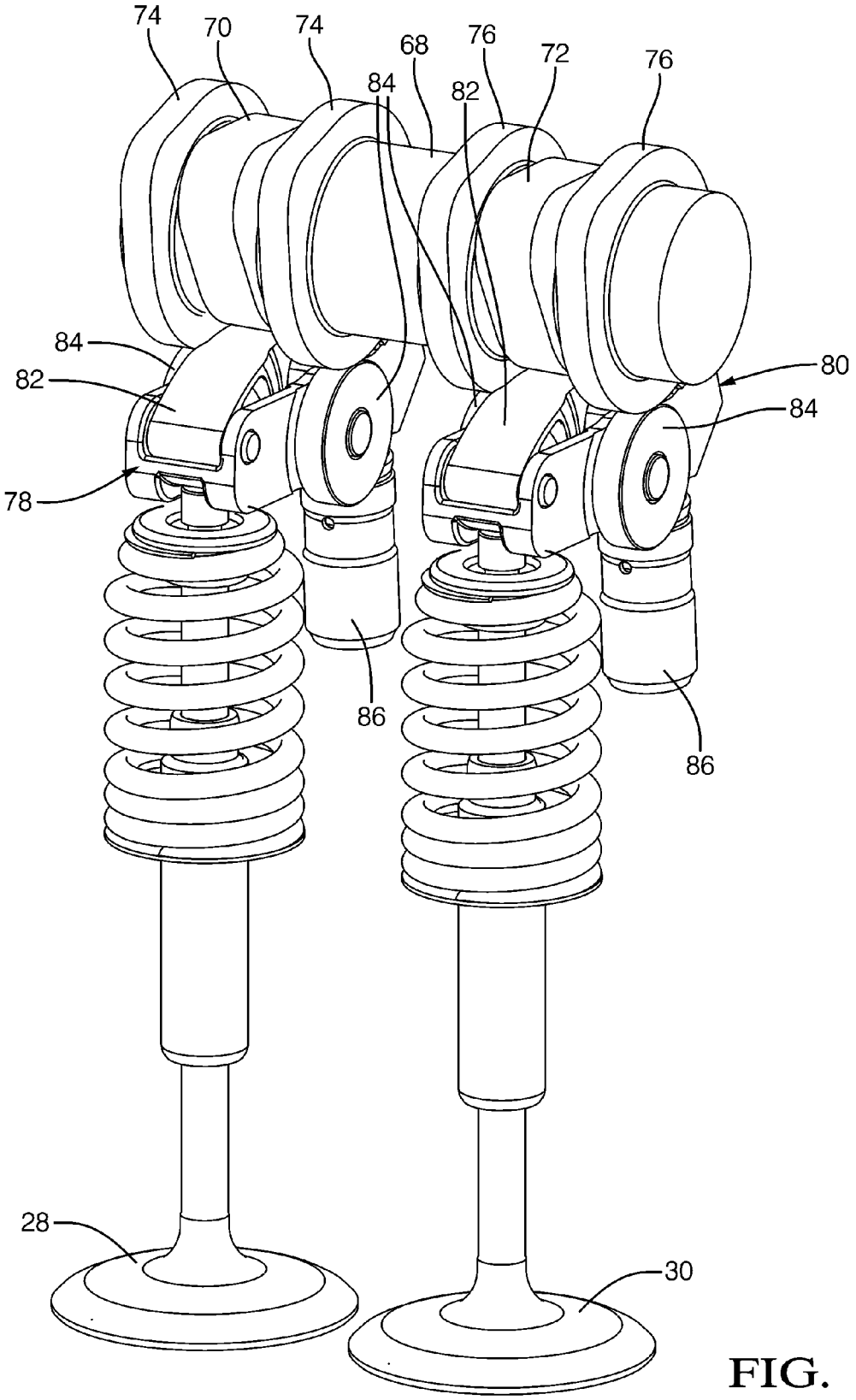
FIG. 5 is an isometric view of the exhaust valve train of the internal combustion engine of FIG. 1.

Now referring to FIGS. 1, 2, and 5; exhaust camshaft 68 is provided in valve train system 12 for moving first and second exhaust valves 28, 30 between the exhaust open and exhaust closed positions. Exhaust camshaft 68 includes first and second center high lift exhaust lobes 70, 72 such that first center high lift exhaust lobe 70 is associated with first exhaust valve 28 and second center high lift exhaust lobe 72 is associated with second exhaust valve 30. Exhaust camshaft 68 also includes first and second outer low lift exhaust lobe pairs 74, 76 such that first center high lift exhaust lobe 70 is disposed between first low lift exhaust lobe pair 74 and is associated with first exhaust valve 28 and second center high lift exhaust lobe 72 is disposed between second low lift exhaust lobe pair 76 and is associated with second exhaust valve 30.

First and second two-step exhaust devices 78, 80 may be provided to transmit motion from exhaust camshaft 68 to first and second exhaust valves 28, 30 respectively. An example of such first and second two-step exhaust devices are two-step roller finger followers as disclosed in U.S. Pat. No. 6,668,779 which is incorporated herein by reference in its entirety. First and second two-step exhaust devices 78, 80 are switchable between a locked and an unlocked position. In the locked position, center exhaust follower 82 is held at a fixed height with respect to outer exhaust followers 84 which are disposed on each side of center exhaust follower 82. In this way, first and second center high lift exhaust lobes 70, 72 act on their respective center exhaust follower 82. As exhaust camshaft 68 rotates, center exhaust follower 82 follows the profile of its respective center high lift exhaust lobe 70, 72. When center exhaust follower 82 follows the valve lifting portion of its center high lift exhaust lobe 70, 72, the two-step exhaust device pivots about exhaust lash adjuster 86, thereby lifting its respective exhaust valve 28, 30 from its respective exhaust valve seat 32, 34.

In the unlocked position, center exhaust follower 82 is not held at a fixed height with respect to outer exhaust followers 84. As center exhaust follower 82 follows the valve lifting portion of its respective center high lift exhaust lobes 70, 72, center exhaust follower 82 is allowed to compress which is known in the art as lost motion. In this way, center exhaust follower 82 does not cause first and second two-step exhaust devices 78, 80 to pivot about exhaust lash adjuster 86 and therefore does not impart motion on its respective exhaust valve 28, 30. As exhaust camshaft 68 rotates, outer low lift exhaust followers 84 follow the profile of their respective outer low lift exhaust lobes pairs 74, 76. In this way, first and second exhaust valves 28, 30 are moved between the exhaust open and exhaust closed positions only by their respective outer low lift exhaust lobe pairs 74, 76. Center high lift exhaust lobes 70, 72 and outer low lift exhaust lobe pairs 74, 76 produce exhaust valve lift that may be similar to that shown in FIG. 4 for intake valves 20, 22.

First and second two-step exhaust devices 78, 80 are each provided with an exhaust lock mechanism (not shown). First and second two-step exhaust devices 78, 80 are placed in the unlocked position when pressurized oil from internal combustion engine 10 is supplied to the exhaust lock mechanism. In this way, center exhaust follower 82 is not held at a fixed height with respect to outer exhaust followers 84. First and second two-step exhaust devices 78, 80 are placed in the locked position when the pressured oil is drained from the exhaust lock mechanism which may be desirable because the motion transmitting position may be the default position for first and second two-step exhaust devices 78, 80. The supply of pressurized oil to the exhaust lock mechanism for each two-step exhaust device 78, 80 may be controlled by first and second exhaust oil control valves 90, 92 respectively which both receive pressurized oil from oil supply 62. First and second exhaust oil control valves 90, 92 may be controlled by input from engine control module 21. In this way, first and second two-step exhaust devices 78, 80 may both be simultaneously placed in the locked or unclocked position or one of the first and second two-step exhaust devices 78, 80 may be placed in the locked position while the other of the two-step exhaust devices 78, 80 may be simultaneously placed in the unlocked position.

Exhaust camshaft 68 may be provided with exhaust camshaft phaser 94 for varying the phase relationship between exhaust camshaft 68 and crankshaft 18. Exhaust camshaft phaser 94 is actuated by electric motor 95. Exhaust camshaft phaser 94 may, for example, include a harmonic gear drive unit, as shown in U.S. patent application Ser. No. 13/215,547 filed on Aug. 23, 2001, which is incorporated herein by reference in its entirety, to vary the phase relationship between exhaust camshaft 68 and crankshaft 18 based on rotational input from electric motor 65. However, it should be understood that the harmonic gear drive unit may be substituted by any number of gear drive units or gear reduction units commonly known for transmitting torque from a driving member to a driven member.

Exhaust camshaft 68 may also include exhaust camshaft sensing means 96 for detecting the rotational position of exhaust camshaft 68. Exhaust camshaft sensing means 96 may be, for example, a conventional camshaft sensor as is well known in the art or Hall Effect sensors of electric motor 95 as taught in U.S. patent application Ser. No. 13/215,547. Exhaust camshaft sensing means 96 provides intake camshaft position information to engine control module 21. In this way, engine control module 21 can determine the phase relationship between crankshaft 18 and exhaust camshaft 68 from the crankshaft position information and exhaust camshaft position information supplied by crankshaft sensor 19 and exhaust camshaft sensing means 96 respectively.

Now referring to FIGS. 1, 2, and 3, when intake camshaft 36 rotates, first and second intake valves 20, 22 open and close. As first and second intake valves 20, 22 are being opened, torque on intake camshaft 36 increases as work is done to compress intake valve springs 98. However, when intake valves 20, 22 are being closed, torque on intake camshaft 36 decreases because intake valve springs 98 expand and return energy to intake camshaft 36. The magnitude of torque increase and torque decrease on intake camshaft 36 is dependent on whether first and second center high lift intake lobes 38, 40 or first and second outer low lift intake lobe pairs 42, 44 are selected to open and close first and second intake valves 20, 22 respectively. Larger torque increases and decrease on intake camshaft 36 occur when first and second center high lift intake lobes 38, 40 are selected to open and close first and second intake valves 20, 22 because intake valve springs 98 are compressed further compared to when first and second outer low lift intake lobe pairs 42, 44 are selected to open and close first and second intake valves 20, 22.

Figure 6:
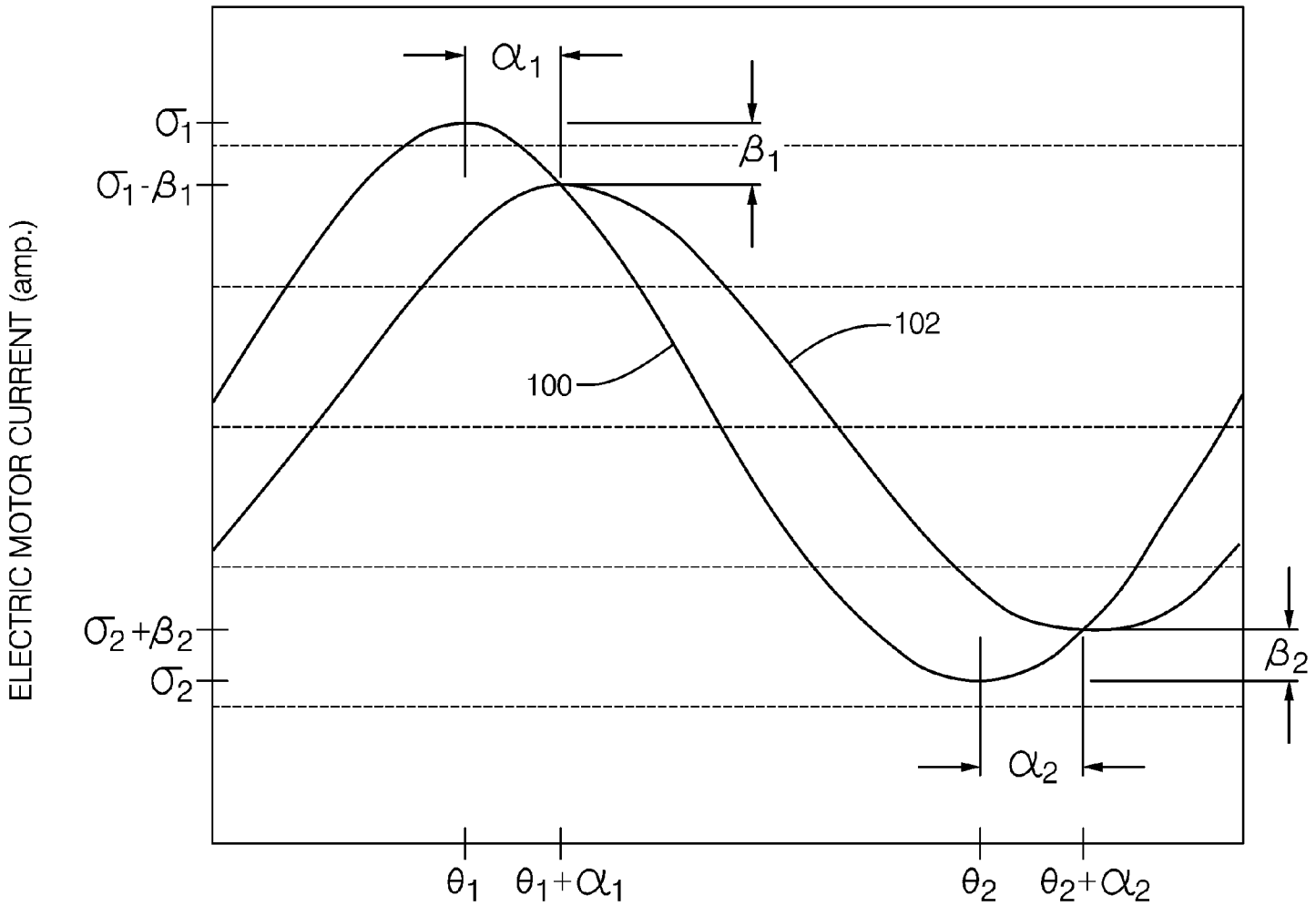
FIG. 6 is a graph plotting intake camshaft angular position against electric current needed to maintain a desired camshaft phaser position in two different intake lift modes.

When no change in phase relationship between intake camshaft 36 and crankshaft 18 is desired, an electric current must be applied to electric motor 65 in the correct magnitude in order to prevent forces from intake valve springs 98/intake camshaft 36 from backdriving intake camshaft phaser 64. As a result of the changing torque on intake camshaft 36 from first and second intake valves 20, 22 opening and closing, the current applied to electric motor 65 will needs to be varied in order to offset the changing torque. FIG. 6 shows how the electric current applied to electric motor 65 varies with rotation of intake camshaft 36 for both high lift mode and low lift mode where high lift mode is represented by high lift current trace 100 and low lift mode is represented by low lift mode current trace 102. As can be seen, the maximum electric current applied to electric motor 65 to maintain a phase relationship between intake camshaft 36 and crankshaft 18 when high lift mode is selected is $\sigma_1$ amps while the maximum electric current applied to electric motor 65 when low lift mode is selected is $\beta_1$ amps less than $\sigma_1$. Also as can be seen, the peak of high lift current trace 100 occurs at an intake camshaft position (or phase angle) of $\theta_1$ while the peak of low lift current trace 102 is shifted by $\alpha_1$. This shift by $\alpha_1$ is the result of the difference in the angular positions of the peaks of first and second center high lift intake lobes 38, 40 and first and second outer low lift intake lobe pairs 42, 44. Similarly, the minimum electric current applied to electric motor 65 to maintain a phase relationship between intake camshaft 36 and crankshaft 18 when high lift mode is selected is $\sigma_2$ amps while the minimum electric current applied to electric motor 65 when low lift mode is selected is $\beta_2$ amps more than $\sigma_2$. Also similarly, the trough of high lift current trace 100 occurs at an intake camshaft angular position of $\theta_2$ while the trough of low lift current trace 102 is shift by $\alpha_2$. Accordingly, the amplitude of high lift current trace 100 is defined to be $\sigma_1$-$\sigma_2$ while the amplitude of low lift current trace 102 is defined to be $(\sigma_1-\beta_1)$-$(\sigma_2+\beta_2)$. This pattern will repeat for each revolution of intake camshaft 36. This pattern will also repeat for each cylinder 11*a*, 11*b*, 11*c*, and 11*d*, however, the pattern will be at a distinct rotational position of camshaft 36 for each cylinder 11*a*, 11*b*, 11*c*, and 11*d*.

Since the current supplied to electric motor 65 is predictable based on the camshaft position and the mode that first and second two-step intake devices 46, 48 are placed in, the current supplied to electric motor 65 may be used to determine if one or both first and second two-step intake devices 46, 48 are in the desired mode or if one or both of first and second two-step intake devices 46, 48 have failed to be placed in the desired mode. This determination may be made by comparing the amplitude of the actual current supplied to electric motor 65 at a given camshaft position with the amplitude of the electric current that is expected to be supplied to electric motor 65 at the given camshaft position for the commanded mode of first and second two-step intake devices 46, 48. If the amplitude of the actual current is within an acceptable tolerance range of the amplitude of the expected electric current, then both first and second two-step intake devices 46, 48 are in the desired mode. Conversely, if the amplitude of the actual current is not within the acceptable tolerance range of the amplitude of the expected electric current, then one or both of first and second two-step intake devices 46, 48 have failed to be placed in the desired mode. Furthermore, if the amplitude of the actual current is not within the acceptable tolerance range of the amplitude of the expected electric current, the extent to which the amplitude of the actual current is not within the acceptable tolerance range of the amplitude of the expected electric current can be used to determine if it is just one or if it is both first and second two-step intake devices 46, 48 because the extent to which the amplitude of the actual current is not within the acceptable tolerance range of the expected electric current will be different for only one of first and second two-step intake devices 46, 48 failing to be placed in the desired mode compared to both first and second two-step intake devices 46, 48 failing to be placed in the desired mode.

Similarly, when a change in phase relationship between intake camshaft 36 and crankshaft 18 is desired, an electric current must be applied to electric motor 65 in the correct magnitude in order to rotate intake camshaft 36 relative to crankshaft 18 at a predetermined rate. In order to maintain rotation of intake camshaft 36 to crankshaft 18 at the predetermined rate, the amplitude of the current applied to electric motor 65 will also change in order to accommodate the changing torque as a result of forces from intake valve springs 98/intake camshaft 36. In this way, the amplitude of the current supplied to electric motor 65 is predictable based on the camshaft position and the mode that first and second two-step intake devices 46, 48 are placed in just as in the previous example when no change in phase relationship is being made. Accordingly, the current supplied to electric motor 65 may be used to determine if one or both first and second two-step intake devices 46, 48 are in the desired mode or if one or both of first and second two-step intake devices 46, 48 have failed to be placed in the desired mode.

Each cylinder 11*a*, 11*b*, 11*c*, 11*d* of internal combustion engine 10 includes its own pair of two-step intake devices as shown in FIG. 1. Each pair of two-step intake devices may move their associated intake valves from intake closed position to the intake open position and back to the intake closed position at an angular position range of intake camshaft 36 that is distinct from every other pair two-step intake devices. Since each pair of two-step intake devices has a distinct period in the intake open position, the rotational position of intake camshaft 36 can be used to identify which of cylinders 11*a*, 11*b*, 11*c*, and 11*d* has had one or both of first and second two-step intake devices 46, 48 fail to be placed in the desired mode.

Figure 7:
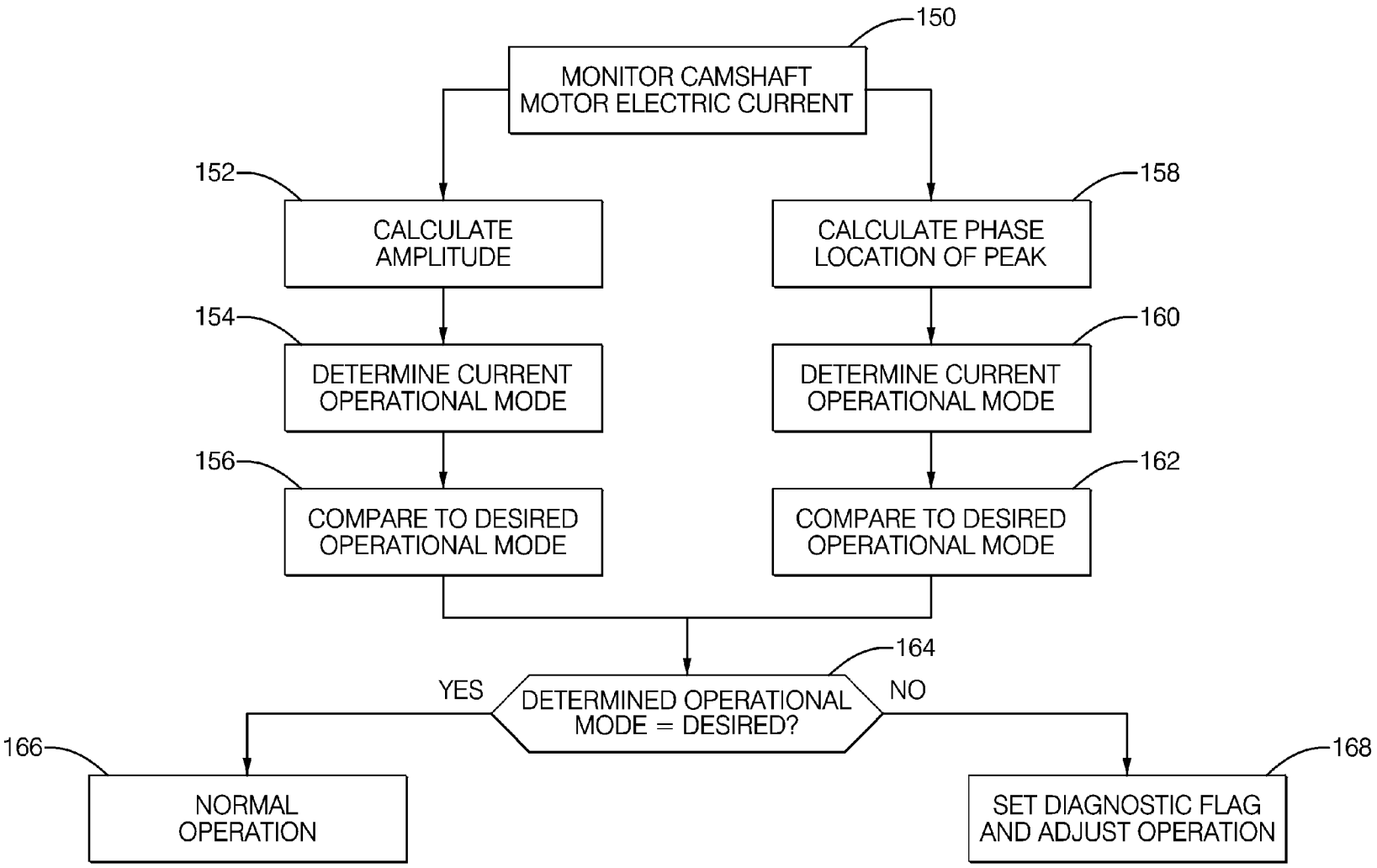
FIG. 7 is a flow chart showing a method for diagnosing a multi-mode valve train device.

Reference will now be made to FIG. 7 which shows a flow chart used to determine if first and second two-step intake devices 46, 48 are placed in the desired operational mode after intake camshaft phaser 64 and first and second two-step intake devices 46, 48 have been commanded to respective operational modes. In operation, a variable electric current (as shown in FIG. 6) is supplied to electric motor 65 to achieve the desired operational mode of intake camshaft phaser 64. In step 150, a parameter of intake camshaft phaser 64 is monitored which is indicative of the electric current supplied to electric motor 65. In this example, the parameter is shown as camshaft motor electric current. In step 152, a characteristic of the monitored parameter of step 150 is calculated. In this example, the characteristic is the amplitude of the camshaft motor electric current. The current operational mode of first and second two-step intake devices 46, 48 is determined in step 154 by looking up (for example a table in engine control module 21) the operational mode of first and second two-step intake devices 46, 48 which results in the amplitude of the electric current supplied to electric motor 65 to achieve the desired operational mode of intake camshaft phaser 64. In step 156, the current operational mode of first and second two-step intake devices 46, 48 determined in step 154 is compared to the commanded operational mode of first and second two-step intake devices 46, 48.

In step 158, another characteristic of the monitored parameter of step 150 is calculated. In this example, the characteristic is the phase location of the peak of the camshaft motor electric current. The current operational mode of first and second two-step intake devices 46, 48 is determined in step 160 by looking up (for example a table in engine control module 21) the operational mode of first and second two-step intake devices 46, 48 which results in the phase location peak of the electric current supplied to electric motor 65 to achieve the desired operational mode of intake camshaft phaser 64. In step 162, the current operational mode of first and second two-step intake devices 46, 48 determined in step 160 is compared to the commanded operational mode of first and second two-step intake devices 46, 48.

In step 164, a determination is made if the current operational mode of first and second two-step intake devices 46, 48 is equal to the commanded operational mode of first and second two-step intake devices 46, 48. If the comparisons of steps 156 and 162 both show that the current operational mode of first and second two-step intake devices 46, 48 are the same as the commanded operational mode, then normal operation of internal combustion engine 10 may continue as shown in step 166. Conversely, if one or both of the comparisons of steps 156 and 162 show that the current operation mode of first and second two-step intake devices 46, 48 are not the same as the commanded operational mode, then operation of internal combustion engine 10 may be altered and a diagnostic flag may be set, for example a malfunction indicator lamp (not shown), to indicate that service to internal combustion engine 10 may be needed as shown in step 168.

While FIG. 7 is shown with steps 152, 154 and 156 running parallel with steps 158, 160, and 162, it should now be understood that one of the parallel branches may eliminated, thereby using only one branch to determine if first and second two-step intake devices 46, 48 are placed in the desired operational mode. It should now also be understood that addition or substitute parallel branches may be included using other characteristics of the variable electric current.

While the previous examples have described using electric current supplied to electric motor 65 of intake camshaft phaser 64 and the rotational position of intake camshaft 36 to determine if one or both first and second two-step intake devices 46, 48 are in the desired mode or if one or both of first and second two-step intake devices 46, 48 have failed to be placed in the desired mode, it should now be understood that using electric current supplied to electric motor 95 of exhaust camshaft phaser 94 and the rotational position of exhaust camshaft 68 to determine if one or both of first and second two-step exhaust devices 78, 80 are in the desired mode or if one or both of first and second two-step exhaust devices 78, 80 have failed to be placed in the desired mode.

While the examples above have used current supplied to electric motor of the camshaft phaser as the parameter used to determine the operational state of the two-step device, other parameters of the camshaft phaser could also be monitored to determine the operational state of the two-step device. As one example, the actual phase angle between the camshaft and the crankshaft is determined by comparing the crank position with the intake cam position. The actual phase angle compared with the desired phase angle is the phase angle error of the camshaft phaser. Since the high lift mode of the two-step device results in higher torque on the camshaft, a higher phase angle error of the camshaft phaser will result when the two-step device is in the high lift mode compared to when the two-step device is in the low lift mode. Accordingly, phase angle error of the camshaft phaser is another parameter that may be used to determine the operational state of the two-step device.

While internal combustion engine 10 has been illustrated as an in-line, four cylinder engine with two intake valves and two exhaust valves per cylinder, it should now be understood that other arrangements are also possible. For example, internal combustion engines with other quantities of cylinders as well as internal combustion engines which include two banks of cylinders commonly referred to as "V" type arrangements may utilize this invention. It should also now be understood that other quantities of intake and exhaust valves for each cylinder may be used, for example, one intake valve and one exhaust valve.

While valve train system 12 has been illustrated as having two intake valves and two exhaust valves for each cylinder and each intake and exhaust valve having a respective two-step device, it should now be understood that each cylinder may have more or fewer intake valves and exhaust valves with each intake and exhaust valve having a respective two-step device. It should also now be understood that each valve of a given cylinder need not have a respective two-step device, that is, some intake valves and/or exhaust valves of a given cylinder may have a respective two-step device while other intake valves and/or exhaust valves of the given cylinder may not have a respective two-step device. It should also now be understood that different cylinders within internal combustion engine 10 may have different numbers of two-step devices.

While the embodiment described above employs two-step roller finger followers as the two-step intake and exhaust devices, it should now be understood that deactivation roller finger followers may also be diagnosed in the same way. It should also now be understood that conventional roller finger followers or rocker arms may be used and deactivation lash adjusters, deactivation hydraulic valve lifters, or other two-step and deactivation devices may be diagnosed in the same way. In general, these deactivation and two-step devices may be referred to as multi-mode valve train devices. It should also now be understood that low-lift encompasses no-lift or deactivation.

While this invention has been described in terms of preferred embodiments thereof, it is not intended to be so limited, but rather only to the extent set forth in the claims that follow.

I claim:

1. A method for diagnosing a multi-mode valve train device for selectively providing high lift and low lift to a combustion valve of an internal combustion engine having a camshaft phaser actuated by an electric motor for varying the phase relationship between a camshaft and a crankshaft of said internal combustion engine, said method comprising:

applying a variable electric current to said electric motor to achieve a desired camshaft phaser operational mode;

commanding said multi-mode valve train device to a desired valve train device operational mode selected from a high lift mode for providing high lift to said combustion valve and a low lift mode for providing low lift to said combustion valve;

monitoring said variable electric current or a parameter of said camshaft phaser that is indicative of said variable electric current;

calculating a first characteristic of said variable electric current or said parameter;

determining a first actual valve train device operational mode of said multi-mode valve train device by comparing said calculated first characteristic against a predetermined value of said first characteristic measured when said multi-mode valve train device is known to be in said desired valve train device operational mode.

2. A method as in claim 1 wherein said first characteristic is the amplitude of said variable electric current.

3. A method as in claim 1 wherein said first characteristic is the phase location of the peak of said variable electric current.

4. A method as in claim 1 further comprising:

determining said multi-mode valve train device is in said desired valve train device operational mode if said first actual valve train device operational mode matches said desired valve train device operational mode; or determining said multi-mode valve train device is not in said desired valve train device operational mode if said first actual valve train device operational mode does not match said desired valve train device operational mode.

5. A method as in claim 1 further comprising:

calculating a second characteristic of said variable electric current or said parameter;

determining a second actual valve train device operational mode of said multi-mode valve train device by comparing said calculated second characteristic against a predetermined value of said second characteristic measured when said multi-mode valve train device is known to be in said desired valve train device operational mode; and either determining said multi-mode valve train device is in said desired valve train device operational mode if said first actual valve train device operational mode and said second actual valve train device operational mode both match said desired valve train device operational mode; or determining said multi-mode valve train device is not in said desired valve train device operational mode if at least one of said first actual valve train device operational mode and said second actual valve train device operational modes do not match said desired valve train device operational mode.

6. A method as in claim 1 wherein said internal combustion engine is a multi-cylinder internal combustion engine and at least two cylinders include a multi-mode valve train device, said method further comprising identifying which cylinder of said internal combustion engine said first actual valve train device operational mode matches said desired valve train device operational mode and which cylinder of said internal combustion engine said first actual valve train device operational mode does not match said desired valve train device operational mode by using a means for determining camshaft position.

7. A method for diagnosing first and second multi-mode valve train devices for selectively providing high lift and low lift to first and second combustion valves respectively of a cylinder of an internal combustion engine having a camshaft phaser actuated by an electric motor for varying the phase relationship between a camshaft and a crankshaft of said internal combustion engine, said method comprising:

applying a variable electric current to said electric motor to achieve a desired camshaft phaser operational mode;

commanding said first multi-mode valve train device to a desired first valve train device operational mode selected from a first high lift mode for providing high lift to said first combustion valve and a first low lift mode for providing low lift to said first combustion valve;

commanding said second multi-mode valve train device to a desired second valve train device operational mode selected from a second high lift mode for providing high lift to said second combustion valve and a second low lift mode for providing low lift to said second combustion valve;

monitoring said variable electric current or a parameter of said camshaft phaser that is indicative of said variable electric current;

calculating a characteristic of said variable electric current or said parameter;

determining an actual valve train device operational mode of said first and second multi-mode valve train devices by comparing said calculated characteristic against a predetermined value of said characteristic measured when said first and second multi-mode valve train devices are known to be in said desired first valve train device operational mode and said desired second valve train device operational mode respectively.

8. A method as in claim 7 wherein said characteristic is the amplitude of said variable electric current.

9. A method as in claim 7 further comprising determining if one or both of said first and second multi-mode valve train devices is not in said desired first valve train device operational mode and said desired second valve train device operational mode.

10. A method as in claim 9 wherein the extent to which said calculated characteristic differs from said predetermined value of said characteristic is used to determine if one or both of said first and second multi-mode valve train devices is not in said desired first valve train device operational mode and said desired second valve train device operational mode.

* * * * *